United States Patent [19]

Erickson

[11] 4,310,288

[45] Jan. 12, 1982

[54] METHOD AND APPARATUS FOR IMPROVING EROSION RESISTANCE OF THE MIXING CHAMBER OF A JET PUMP

[75] Inventor: John W. Erickson, Huntington Beach, Calif.

[73] Assignee: Kobe, Inc., Commerce, Calif.

[21] Appl. No.: 23,203

[22] Filed: Mar. 23, 1979

[51] Int. Cl.[3] ..... F04F 5/26; F04F 5/46

[52] U.S. Cl. ..... 417/54; 417/160; 417/170; 417/171; 417/172; 417/177; 417/179; 417/198

[58] Field of Search ..... 417/160, 172, 177, 198, 417/163–170, 171, 197, 151, 179, 180, 87, 54, 55

[56] References Cited

U.S. PATENT DOCUMENTS

| | | | |
|---|---|---|---|
| 584,394 | 6/1897 | McDonald | 417/177 |
| 631,007 | 8/1899 | Farrar | 417/179 |
| 1,495,185 | 5/1924 | Kirgan | 417/177 X |
| 1,737,887 | 12/1929 | Kroscov | 417/163 |
| 2,165,880 | 7/1939 | Arkin et al. | 417/177 X |
| 2,444,615 | 7/1948 | Reinhardt | 417/197 |
| 2,674,202 | 4/1954 | Kelley et al. | 417/172 |
| 3,175,515 | 3/1965 | Cheely | 417/197 |

FOREIGN PATENT DOCUMENTS

| | | | |
|---|---|---|---|
| 1046023 | 12/1953 | France | 417/197 |

*Primary Examiner*—William L. Freeh
*Assistant Examiner*—Edward Look
*Attorney, Agent, or Firm*—William C. Norvell, Jr.

[57] ABSTRACT

To improve the erosion resistance of the mixing chamber of a jet pump employed to pump particulate containing fluids, this invention contemplates directing a pressurized source of clean fluid through an annular jet-type orifice, thus providing an annular jet of high velocity clean fluid at the inlet end of the mixing chamber which surrounds an orifice connected to the source of particulate containing fluid and effects the pressurizing and pumping of the particulate containing fluid by the well known jet diffusion technique. Additionally, this invention contemplates the provision of a second annular nozzle surrounding the first mentioned annular nozzle through which a relatively clean fluid is discharged, thereby interposing a clean fluid barrier between the momentumly transferred particulate containing fluid and the surface of the mixing chamber to protect such surface from the abrading effects of the particulate material. In a modification of the invention, the relatively particulate-free fluid stream is produced by diverting a portion of the pressurized clean fluid supplied to the jet pump to effect the centrifugal separation of the particulate containing fluid into two streams, respectively a radially inner stream relatively free of particulate which is supplied to the aforementioned outermost annular orifice and a central particulate rich stream which is supplied to the central orifice of the mixing chamber and educted therefrom by the annular high velocity jet stream of clean fluid.

6 Claims, 3 Drawing Figures

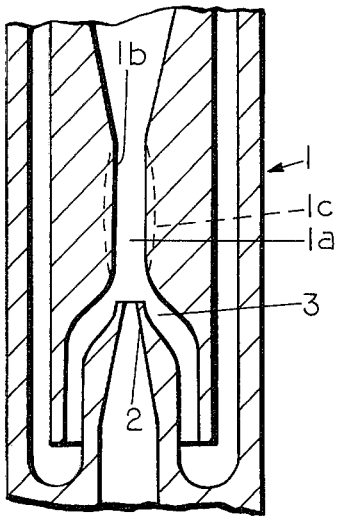
PRIOR ART
FIG. 1
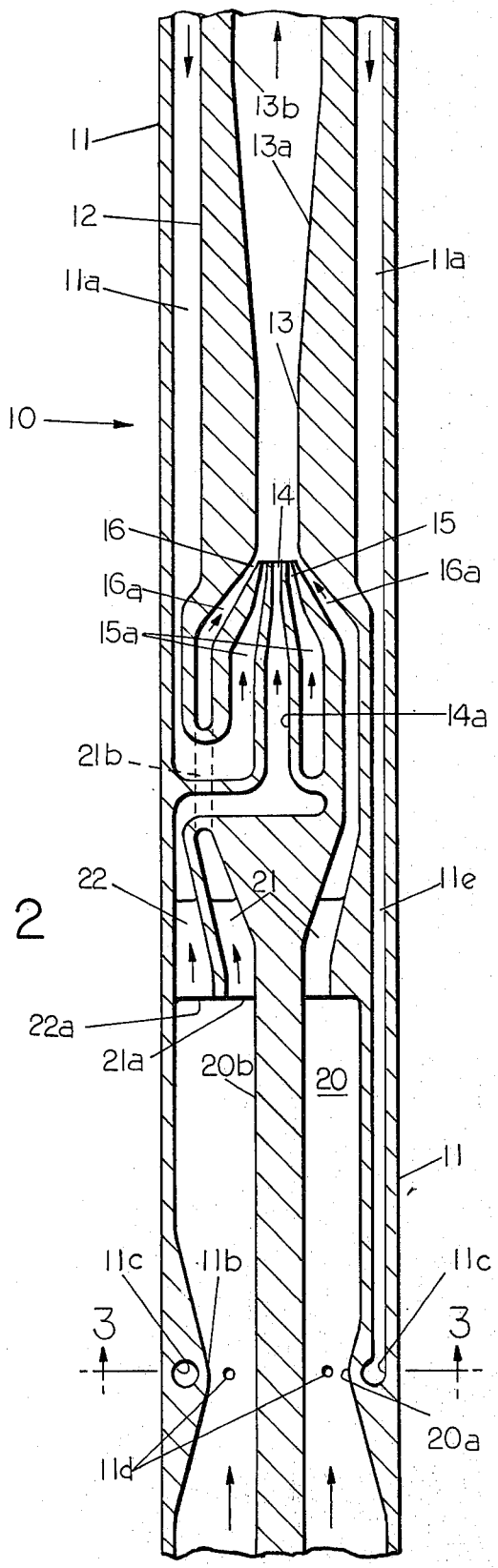
FIG. 2
FIG. 3
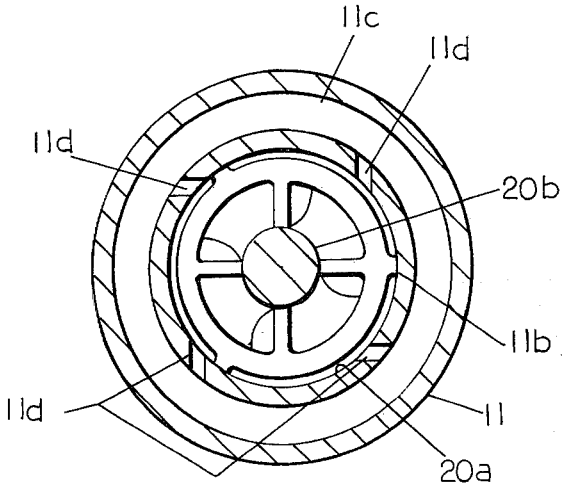

METHOD AND APPARATUS FOR IMPROVING EROSION RESISTANCE OF THE MIXING CHAMBER OF A JET PUMP

BACKGROUND OF THE INVENTION

1. Field of the Invention

Jet pumps have long been utilized in many industrial applications and are particularily useful for installation in the bottom of an oil well to effect the pumping of oil from the well. In general terms, a conventional jet pump provides a stream of fluid supplied from a pressure source at the surface of the well which is discharged at high velocity into a mixing chamber to which the fluid to be pumped is supplied, generally by an annular orifice surrounding the nozzle producing the jet stream. The mixing action of the jet stream on the fluid to be pumped converts the jet energy of the stream into sufficient pressure to pump the oil and supplied fluid to the top of the well.

When the fluid to be pumped contains any significant quantity of particulate material, and, in the case of oil wells, significant quantities of sand, there is a serious abrading or erosion effect on the walls of the mixing chamber produced by such particulate material which is necessarily impacted against such walls at relatively high speeds by the momentum transfer action of the high velocity jet. This necessitates frequent shut downs of the jet pump for replacement of the mixing chamber wall and hence is a significant factor impeding the production from an oil well or the operation of any other piece of industrial equipment in which the jet pump is employed.

2. Description of the Prior Art

The efforts employed in the prior art to increase the life of the mixing chambers of jet pumps have been primarily directed toward making the wall of the mixing chamber readily replaceable and developing abrasion resistant alloys for such replaceable wall portions. The prior art has not indicated that a more simple solution lies in providing a protective fluid screen within the mixing chamber to substantially prevent the particulate material from engaging the walls of the mixing chamber.

SUMMARY OF THE INVENTION

A method and apparatus are provided for improving the effective life of the walls of a mixing chamber of a jet pump required to pump fluids containing significant quantities of abrasive particulate material. The invention contemplates introducing the particulate containing fluid into the mixing chamber through a central axially disposed orifice and surrounding such orifice with an annular jet-type orifice through which a jet of high velocity cleaning fluid is projected to effect the eduction of the particulate containing fluid from the central orifice and, by the known momentum transfer process, converts the kinetic energy of the high velocity jet into a pressure head effective to pump the particulate containing fluid and the supplied jet fluid. Additionally, this invention contemplates providing a second annular orifice in the entry end of the mixing chamber in surrounding relationship to the other orifices and connecting such outer annular orifice to a source of relatively clean fluid so that such fluid is also educted from its orifice by the annular jet which is surrounds, but is positioned between the high velocity jet, which is mixed with the particulate containing fluid as it passes through the chamber, and the walls of the chamber, thus effectively reducing to a minimum the contact of high velocity abrasive particulates with the walls of the chamber.

In accordance with a modification of this invention, the relatively clean fluid employed to surround and isolate the particulate containing fluid in the jet pump is derived by centrifugal separation of the particulate containing fluid at the inlet end of the pump into two radially separated streams, the inner stream, being relatively free of particulate, being then supplied to the outer annular orifice and the outer stream, containing most of the particulates, being introduced into the central orifice at the inlet end of the mixing chamber of the jet pump.

BRIEF DESCRIPTION OF THE DRAWINGS

FIG. 1 is an axial section view of the mixing chamber portion of a conventional jet pump.

FIG. 2 is a schematic, axial sectional view of a jet pump constructed in accordance with this invention.

FIG. 3 is a sectional view taken on the plane 3—3 of FIG. 2.

DESCRIPTION OF THE PREFERRED EMBODIMENTS

In FIG. 1 there is shown a portion of a conventional jet pump 1 wherein an axial orifice 2 projects a high velocity jet of clean fluid axially along the center of a mixing chamber 1*a*. Such clean fluid is supplied from any suitable source. Surrounding the nozzle 2 is an annular orifice 3 which is suitably connected to a source of fluid to be pumped. The pumping action is produced by the well known momentum transfer process with the fluid to be pumped being educted from the annular orifice 3 and entrained by the jet stream emerging from the nozzle 2. The kinetic energy of the jet stream is transformed into hydraulic pressure sufficient to effect the pumping of both the fluid flowing through the annular orifice 3 and the jet fluid.

In many cases, and particularly in the case of oil wells, the fluid to be pumped may contain significant quantities of abrasive particulate material. Such material is, of course, accelerated to significant velocities by the momentum transfer action of the jet stream and caused to impinge against the mixing chamber wall 1*b*, resulting in the abrading and erosion of such wall which generally, after a relatively short period of use under such adverse conditions, assumes a configuration indicated by the dotted line 1*c*. This configuration adversely affects the efficiency of the pump, hence requiring the shutting down of the pump in order to effect the replacement of the eroded mixing chamber wall.

Referring now to FIG. 2, there is schematically shown a jet pump construction 10 which minimizes the erosion effect of particulate contained in the fluid to be pumped on the walls of the mixing chamber. It should be mentioned that for clarity of illustration, the device shown in FIG. 2 is indicated as being a unitary casting, but those skilled in the art will recognize that it would be very difficult to produce an enclosed cylindrical casting with all of the internal conduits formed therein as shown in FIG. 2; hence, the showing of FIG. 2 is intended to be purely schematic and the pump would be constructed from a number of castings which are subsequently machined, assembled and sealed together to form a rigid structure.

In any event, the pump 10 comprises an outer cylindrical wall 11 and at one axial end, an inner annular wall 12, the central portion of which defines a mixing chamber 13. The jet nozzle for supplying high velocity fluid to such chamber is located at the bottom end of the chamber as viewed in FIG. 2, and the top end of chamber 13 is gradually enlarged as indicated at the diffuser 13*a* to form a discharge conduit 13*b* which, in the case of an oil well, is connected to a string of tubing extending to the top of the well.

Three separate nozzles or inlet orifices are provided at the bottom end of mixing chamber 13, there being respectively a central orifice 14, surrounded by an annular jet producing orifice 15, which in turn is surrounded by a second annular orifice 16. The center orifice 14 is connected by a suitable conduit 14*a* formed in the pump body 10 to a source of particulate containing fluid. The annular jet-type orifice 15 is connected by conduit 15*a* to the annular space 11*a* defined between interior wall member 12 and outer wall member 11. This annular space or passage 11*a* is in turn connected to a suitable source of pressurized clean fluid. In the case of an oil well, the pressurized clean fluid is supplied from the top of the well and a tubing string (not shown) is provided which connects with the annular passage 11*a*.

The outermost annular orifice 16 is connected by a suitable passageway 16*a* to a source of relatively clean fluid. Such fluid may be supplied either from the top of the well or, in accordance with the preferred embodiment of this invention, may be derived from a separator chamber 20 which is formed within the jet pump wall 11.

In either event, the pressurized clean fluid issues from the jet-type orifice 15 at high velocity and in an axial direction to produce an eduction action on the particulate containing fluid provided in the central orifice 14 and the relatively clean fluid provided in the outer annular nozzle 16. In accordance with the well known momentum transfer process which occurs in jet pumps, the kinetic energy of the annular jet stream issuing from jet orifice 15 draws fluid from both the central orifice 14 and the outer annular orifice 16 and the kinetic energy of the jet stream is converted into a pressure head sufficient to pump the mixed fluid to its desired destination, in the case of an oil well, to the top of the well. The significant point, however, is that the fluid containing particulate is disposed in the center of the mixing chamber 13 and is surrounded not only by the jet stream issuing from the jet orifice 15 but also the annular stream of relatively clean fluid issuing from the outer annular orifice 16. With this arrangement, the possibility of abrasive contact of the particulates contained in the fluid issuing from the central nozzle 14 with the wall of mixing chamber 13, with the resulting abrasion and erosion effects on such wall, is minimal. By the time the particulates work out to the walls, they are positioned in the expansion throat portion 13*a* and moving with substantially lower velocity. This necessarily results in a significantly longer life for the walls of the mixing chamber, hence permitting the jet pump to be operated for substantially longer periods without down time for servicing.

As previously mentioned, the relatively clean fluid required for the outer annular nozzle 16 may be conveniently derived from the particulate containing fluid entering the pump.

Referring now to the bottom portion of the pump 10, the separator chamber 20 connects with a source of particulate containing fluid (not shown) through a venturi shaped passage 20*a* formed by an inwardly projecting portion 11*b* of the cylindrical outer wall 11 of the pump 10. An annular header chamber 11*c* is formed in such inwardly projecting portion 11*b* of the wall 11 and is connected by a longitudinal passageway 11*e* to the annular space 11*a* which is supplied with pressurized clean fluid from the top of the well in the manner heretofore mentioned. The annular header chamber 11*c* communicates with the interior of the separator chamber 20 through a plurality of circularly spaced, tangentially disposed nozzles 11*d* so that the pressurized clean fluid is tangentially injected into the separation chamber 20, thus imparting a rotational movement to the particulate containing fluid entering such chamber.

Such rotational movement effects the centrifugal separation of the entering fluid into essentially two radially adjacent streams, one stream containing most of the particulate being located adjacent the outer wall of the separator chamber 20 and the other stream, being substantially free of particulate material, being located along the inner wall 20*b* of the annular separation chamber 20. Conduit means 21 and 22 are respectively provided in the pump housing having inlets 21*a* and 22*a* which are radially spaced from each other. Conduit 22 thus receives the particulate rich fraction of the fluid flow in the separator chamber 20 and this conduit is connected to the conduit 14*a* which supplies the central nozzle 14. Conduit 21 has its inlet opening 21*a* adjacent the radially inward portions of the annular separator chamber 20 and hence receives fluid that is substantially free of particulate matter and conducts same through a conduit 21*b* indicated by dotted lines to the annular conduit 16*a*, which supplies the outermost annular orifice 16 of the jet pump.

From the foregoing description, it is readily apparent that the described apparatus, and the particular method of operating same, results in a highly efficient jet pump for the pumping for particulate containing fluids and minimizes the opportunity of high velocity abrading contacts of the particulate materials with the walls of the mixing chamber. Additionally, through the simple expedient of an integrally incorporated separator chamber powered by the same pressurized clean fluid supplied to the pump to produce the jet stream, a separation of the particulate fluid may be effected into two streams, respectively a particulate rich stream and a relatively clean stream, and the latter stream may be directed through the outer annular orifice 16 to provide protection of the interior wall of the mixing chamber 13 from erosion effects of particles contained in the fluid to be pumped.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A jet pump for pumping fluids containing abrasive particulate material comprising: a housing defining a generally cylindrical mixing chamber having fluid inlet means at one axial end thereof and pressurized fluid discharge means at the other axial end; said fluid inlet means comprising an axially central orifice, an annular, substantially axially directed jet producing orifice surrounding said central orifice, and an outer annular orifice surrounding said axially directed jet producing orifice; first conduit means connecting said central orifice to a source of particulate containing fluid to be pumped; second conduit means connecting said annular, axially directed jet-type orifice to a source of high pressure clean fluid to produce a high velocity axial flow of said clean fluid; third conduit means connecting said outermost annular orifice with a low pressure source of relatively clean fluid, whereby said high velocity axial flow of clean fluid exerts a concurrent eduction action on both said particulate containing fluid and said low pressure relatively clean fluid, and pressure is imparted to the particulate containing fluid by momentum transfer of the annular high velocity jet stream issuing from the annular, axially directed jet-type orifice while the relatively clean fluid issuing from the outermost annular orifice protects the wall of said mixing chamber from abrasive contacts by the particulate material in the fluid being pumped; a generally cylindrical separator chamber defined in said housing and having an inlet in communication with the source of particulate containing fluid to be pumped; an annular passage surrounding said separator chamber and connected thereto by a plurality of tangentially disposed nozzles; and fourth conduit means connecting with said second conduit means for directing a portion of said high pressure clean fluid to said annular passage, thereby rotating the particulate containing fluid entering said separator chamber to effect the centrifugal separation thereof into two streams, one containing most of the particulate material and the other being relatively clean, said third conduit means receiving the relatively clean fluid stream and said first conduit means receiving the particulate containing stream.

2. The jet pump defined in claim 1 further comprising a generally cylindrical separator chamber defined in said housing and having an inlet in communication with the source of particulate containing fluid to be pumped, means in the inlet end of the separator chamber for rotating the particulate containing fluid entering said separator chamber to effect the centrifugal separation thereof into two streams, one containing the majority of the particulate material and the other being relatively clean, said third conduit means receiving the relatively clean fluid stream and said first conduit means receiving the particulate containing stream.

3. In a jet pump for pumping particulate containing fluids wherein a high velocity annular jet of pressurized clean fluid is axially injected into one axial end of generally cylindrical mixing chamber, the improvement comprising: means for separating the particulate containing fluid into two streams, one stream being relatively free of particulates and the other stream containing the majority of the particulates; a nozzle located concentrically within the annular jet; conduit means directing said other stream into said nozzle for discharge within said annular jet; whereby said other stream is accelerated by engagement with the surrounding annular jet; an annular nozzle surrounding said annular jet; and conduit means directing said one stream to said annular nozzle, thereby minimizing contact of the particulates in said other stream with the walls of the mixing chamber.

4. The improvement defined in claim 3 wherein said means for separating the particulate containing fluid into two streams comprises a generally cylindrical separation chamber communicating with the source of particulate containing fluid, means for tangentially introducing pressurized clean fluid to said chamber to produce rotational flow of the particulate containing fluid, thereby concentrating the particulate material in the radial outer portions of the separation chamber to form said two streams.

5. A jet pump for pumping fluids containing abrasive particulate matter comprising: a cylindrical pump body defining a generally cylindrical mixing chamber communicating at one axial end with a central axial nozzle surrounded by two concentric annular nozzles and at its other axial end with a discharge conduit, said pump body further defining: an annular conduit surrounding said discharge conduit and connected to a source of pressurized clean fluid; a first passage means in said pump body connecting said annular conduit with the innermost annular nozzle, said pump body further defining an annular separation chamber axially spaced from said nozzles, the remote axial end of said separation chamber being in fluid communication with a source of particulate containing fluid to be pumped, said separation chamber having a venturi-shaped constriction adjacent its inlet end, a plurality of circularly spaced, tangentially disposed nozzle openings in the outer wall of said constriction, a second fluid passage means in said pump body connecting said nozzles with said annular conduit, thereby injecting pressurized clean fluid tangentially into said separation chamber to impart a rotary motion to the particulate containing fluid entering said separation chamber, causing the particulate material to concentrate in the fluid stream adjacent the outer wall of said separation chamber and producing a fluid stream adjacent the inner wall of said separation chamber that is relatively free of the particulates; a third fluid passage means connecting the central portions of the separation chamber at its outlet end with the outermost annular nozzle; and a fourth fluid passage means in said pump body connecting the outer portions of said separation chamber at its outlet end with said central axial nozzle, whereby the jet pumping action of pressurized clean fluid issuing from said innermost annular nozzle produces a pressurized flow of particulate containing fluid through said central nozzle and concurrently a pressurized flow of relatively clean fluid through said outermost annular nozzle, thereby protecting the walls of said mixing chamber from the abrasive effects of the particle rich fluid issuing from said central axial nozzle.

6. The method of protecting the mixing chamber of a jet pump from abrasive effects of a fluid containing particulate matter comprising the steps of: supplying a pressurized flow of clean fluid concurrently to an annular orifice at the inlet end of the mixing chamber and to tangentially disposed nozzles in a separation chamber communicating with a source of particulate containing fluid, thereby centrifugally separating the particulate containing fluid into two streams, one containing most of the particulate materials and the other stream being relatively free of the particulate materials; directing the particulate containing stream into a nozzle located in the center of the annular orifice; and directing the particulate free stream into a second annular orifice concentrically surrounding the first mentioned annular orifice.

* * * * *